US005456196A

United States Patent [19]

Sanvito

[11] Patent Number: 5,456,196

[45] Date of Patent: Oct. 10, 1995

[54] SEWING METHOD INCLUDING A STEP OF DOWNWARDLY FOLDING FACING JUNCTION EDGES OF TWO PARTS OF A WORKPIECE AND A SEWING APPARATUS

[75] Inventor: Roberto Sanvito, Buccinasco, Italy

[73] Assignee: Rimoldi, S.R.L., Milan, Italy

[21] Appl. No.: 53,149

[22] Filed: Apr. 27, 1993

[30] Foreign Application Priority Data

May 28, 1992 [IT] Italy ..... MI92A1317

[51] Int. Cl.[6] ..... D05B 3/12

[52] U.S. Cl. ..... 112/475.04; 112/83; 112/260

[58] Field of Search ..... 112/2, 83, 93, 112/221, 147, 314, 149, 262.1, 262.3, 260

[56] References Cited

U.S. PATENT DOCUMENTS

| | | | |
|---|---|---|---|
| 520,292 | 5/1984 | Betz | 112/147 |
| 2,034,354 | 3/1936 | Popper | 112/262.3 X |
| 4,098,202 | 7/1978 | Marforio et al. | 112/149 X |
| 4,401,044 | 8/1983 | Bowditch | 112/262.3 |
| 4,612,867 | 9/1986 | Rosch et al. | 112/314 |
| 5,269,241 | 12/1993 | Cartabbia | 112/221 X |

*Primary Examiner*—Peter Nerbun
*Attorney, Agent, or Firm*—Laff, Whitesel, Conte & Saret

[57] ABSTRACT

The described sewing machine has a work supporting bed (5) divided into two portions (6, 7) separated from each other by a central slot (8). The parts (2, 3) of a workpiece (M) to be assembled are laid down each on one portion (2, 3) of the work supporting bed (5) and are moved close to each other so that the respective junction edges (G) may mutually match after being vertically folded downwardly within the slot (8). The junction edges (G) thus oriented engage between a needle plate (9) and a presser foot (25) disposed according to vertical planes, for being submitted to the action of feeding and sewing means operating under the work supporting bed.

9 Claims, 4 Drawing Sheets

1
26
7
5
5a
5b
III
27
35a
28
25
9
11a
21
11
III
4
22(15)
6a
12
14
6
10
24a(16a)
17
24(16)
23b(23a)

SEWING METHOD INCLUDING A STEP OF DOWNWARDLY FOLDING FACING JUNCTION EDGES OF TWO PARTS OF A WORKPIECE AND A SEWING APPARATUS

BACKGROUND OF THE INVENTION

1. Field of the Invention

The present invention relates to a sewing machine, in particular for executing assembling seams between two parts of a workpiece, of the type comprising: a base; a horizontal work supporting bed on which the workpiece is laid down; a needle plate arranged to engage the workpiece parts at respectively facing edges; feeding means acting through the needle plate for moving the workpiece forward according to a predetermined stitching direction; a presser foot elastically acting on the workpiece at the needle plate; sewing means acting at the needle plate for making a seam on the workpiece.

The present invention also relates to a sewing method put into practice by said sewing machine.

2. Prior Art

It is known that in sewing machines in general, such as trimming machines, flat bed machines or other sewing machines designed to execute assembling operations, it is normally provided that the parts to be assembled and forming the workpiece be arranged on a horizonal work supporting bed in a mutually superposed position. The junction edges of the parts along which the assembling seam is to be executed, are operatively engaged between a so-called "needle plate", disposed in coplanar relation with the work supporting bed and a presser foot disposed parallelly over the needle plate and elastically urged towards said plate. One or more feed dogs operate through the needle plate under the, presser foot for causing the workpiece to be dragged along according to the direction of the sewing which is simultaneously carried out upon the action of one or more needles reciprocating in a vertical direction through the needle plate itself and cooperating with one or more loopers acting under the needle plate or astride thereof.

Although the above sewing machines give satisfactory results, some problems are encountered when the workpiece parts to be assembled are provided with patterns, such as stripes, checks or the like that must mate in a predetermined manner at the seam joining the parts.

In fact, since the two fabric parts must be necessarily disposed in superposed relation with respect to each other on the work supporting bed and needle plate, at least the pattern of the part disposed underneath is inevitably concealed to the operator's sight.

The only pratical attempt that the operator can A make to solve this problem is to dispose the patterns in a matching relationship when the parts to be assembled are arranged on the work supporting bed. This is however a rather empiric solution in that during the actual execution of the sewing, that is exactly in the most decisive step to the ends of a successful result, there is no possibility of verifying the alignment between the patterns.

In addition, the overlapping of the parts of a workpiece involves great difficulties of practical nature when the workpiece has great surface extensions and/or is very bulky.

There are also assembling machines in which the two parts to be assembled are coplanarly laid down on the work supporting bed, being disposed in side by side relation. The junction edges to be sewn together are moved close to each other and guided on the needle plate which in this case too is located coplanar with the work supporting bed.

During the working step, the junction edges advancing towards the sewing region are moved clone to each other as far as they get in mutual contact and are folded vertically upwardly. At this point the junction edges are trimmed by trimming means associated with the presser foot and are then brought to a position in which they rest on the needle plate before encountering the sewing means.

When sewing machines of the above type are used, however the alignement of the patterns and decorative designs reproduced on the two workpiece parts can be verified in a relatively easy manner only in those case in which the decorative designs are visible on both surfaces of the individual parts. If, on the contrary, the decorative designs are reproduced, for example by printing, only on the face designed to form the exposed surface of the finished product, the operator is almost completely prevented from carrying out said checking. In the connection it is in fact to be pointed out that the fabric parts to be assembled must be disposed on the work supporting bed with the respective decorative designs facing downwardly for enabling the execution of a non-visible seam on the finished product In addition, the sewing machines of this type too can give rise to some problems when the parts to be assembled are very large and bulky. In particular, the maximum dimensions that the parts of a workpiece can have i s substantially defined by the space located under the arm supporting the head over the needle plate, which head in turn contains the needle driving mechanisms.

SUMMARY OF THE INVENTION

The object of the present invention is to eliminate the problems of the known art and, in particular, to enable during the sewing step, checking of the alignment of the patterns or decorative designs reproduced on the parts to be assembled.

Another object of the invention is to provide a sewing machine the work supporting bed of which is completely clear of any structural or operational element capable of limiting the space available for freely laying down the fabric parts to be assembled on the same work supporting bed.

The foregoing and further objects that will become more apparent in the course of the present description are substantially attained by a sewing machine, in particular for carrying out assembling seams between two parts of a workpiece, wherein the work supporting bed has two side portions arranged in such a manner that each support one of said parts of the workpiece and are separated from each other by a slot extending according to the sewing direction and adapted to engage the facing edges of said parts, vertically folded downwardly, for guiding them between the needle plate and presser foot, said plate and foot being disposed according to vertical planes under the work supporting bed, together with said base, sewing means and feeding means.

Still in accordance with the present invention, this sewing machine carries out a new sewing method comprising the following steps: disposing in coplanar relation according to a horizontal plane two parts of a workpiece exhibiting respectively facing junction edges; folding the junction edges of the individual parts of the workpiece vertically downwardly; moving the workpiece parts close to each other so as to make the folded junction edges mutually match;

sewing together the mutually mating junction edges folded downwardly.

BRIEF DESCRIPTION OF THE DRAWINGS

Further features and advantages will become more apparent from the detailed description of some preferred embodiments of a sewing machine, in particular for assembling parts of a workpiece, as well as the sewing method carried out by said machine, in accordance with the present invention. This description will be given hereinafter by way of non-limiting example with reference to the accompanying drawings, in which.

DESCRIPTION OF THE PREFERRED EMBODIMENTS

Figure 1:
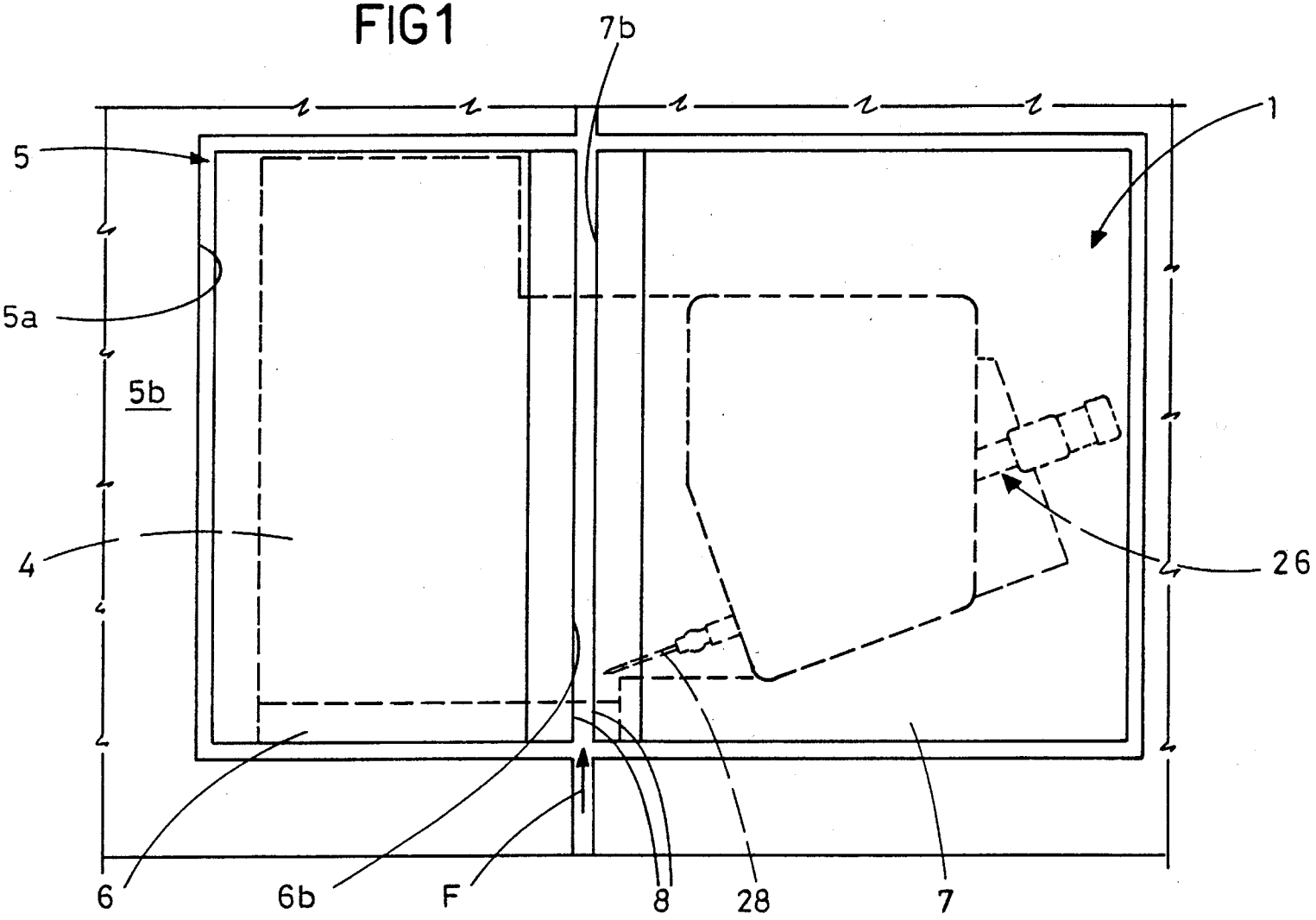
FIG. 1 is a top view of the sewing machine in reference.

Referring to the drawings a sewing machine, in particular for assembling parts of a workpiece in accordance with the present invention, has been generally identified by reference numeral 1.

Figure 2:
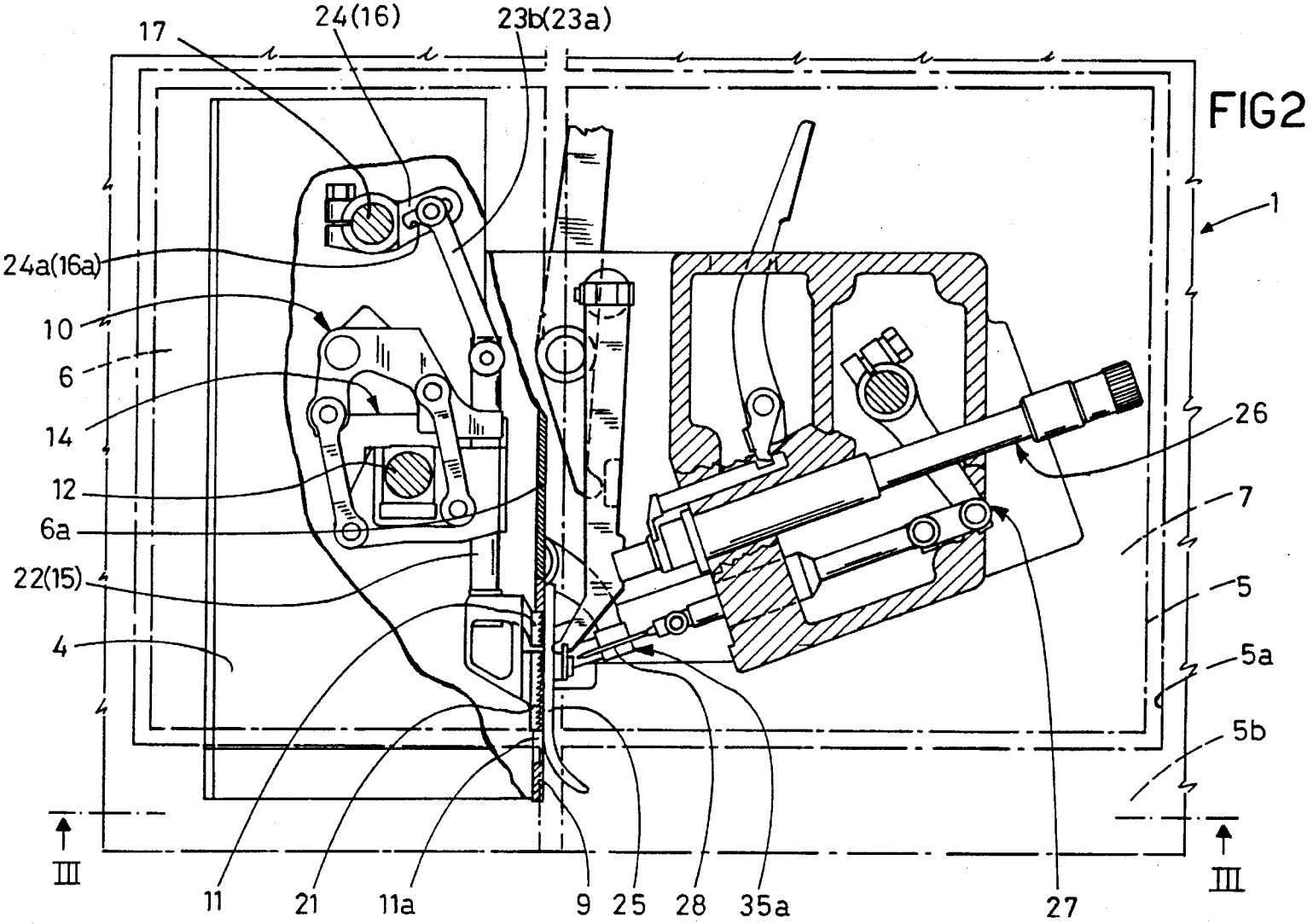
FIG. 2 shows the sewing machine of FIG. 1 partly sectioned according to a horizontal plane.
Figure 4:
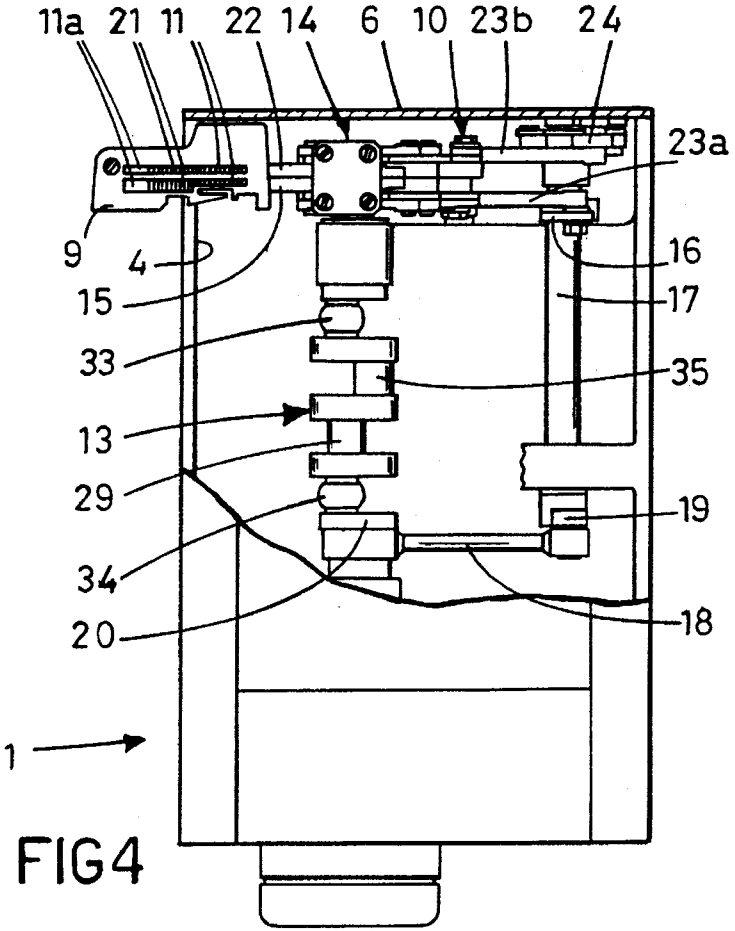
FIG. 4 shows the sewing machine sectioned according to line IV—IV in FIG. 3.
Figure 3:
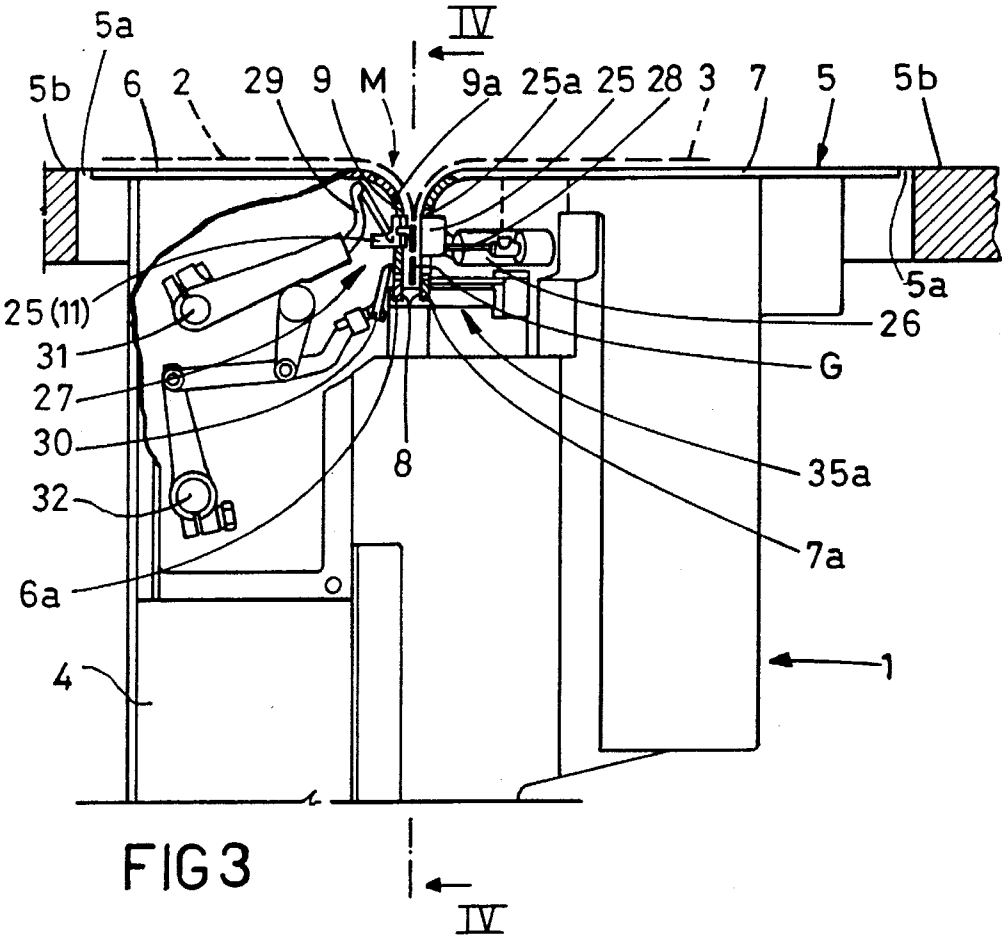
FIG. 3 is a part sectional view of the sewing machine in reference, carried out according to line III—III in FIG. 2.

In the embodiment shown in FIGS. 1 to 3, the sewing machine 1 is arranged to carry out the mutual assembling of first and second parts 2, 3, forming a workpiece "M", by executing an overseaming along the facing junction edges "G" of the parts and simultaneously trimming said junction edges in the same manner as in traditional trimming-overseaming machines.

To this end, the sewing machine 1 comprises a base 4 carrying a horizontal work supporting bed 5 on which the parts 2, 3 of a workpiece are laid down at least over a portion of their overall extension.

In the embodiment shown the work supporting bed 5 is disposed in coplanar relation with an opening 5*a* suitably formed in a so-called "table" 5*b* disposed horizontally.

In accordance with the present invention, the work supporting bed 5 has first and second side portions 6, 7 disposed side by side and arranged each to support one of the parts 2, 3 of a workpiece "M" so that said parts are close to each other and substantially in coplanar relation. The two side portions 6, 7 are separated from each other by a slot 8 extending parallelly to the seam to be made on the workpiece "M" and arranged to engage the mutually matching junction edges "G" folded vertically downwardly, for the purposes to be clarified in the following.

Close to the slot 8 the si de port ions 6, 7 terminate with respective vertical guide stretches 6*a*, 7*a* disposed parallelly in side by side relation to define the width size of the slot itself.

A needle plate 9 is fastened to the base 4 and, in accordance with the present invention, it is oriented according to a vertical plane and disposed under the work supporting bed 5, at a seating 9*a* formed in one of the vertical guide stretches 6*a* associated, in the example shown, with the first side portion 6 of the work supporting bed.

Feeding means 10 operates through the needle plate 9 and is designed to act on the junction edges "G" so as to make the workpiece "M" advance according to a given sewing direction, shown by arrow "F" in FIG. 1.

The feeding means 10 essentially comprises at least one main feed dog 11 driven with cyclic movements, through a corresponding opening 11*a* formed in the needle plate 5, according to a trajectory contained in a horizontal plane. This movement is obtained through the combination between a transverse reciprocating motion directed perpendicularly to the extension plane of the needle plate 5, and a longitudinal reciprocating motion oriented according to the sewing direction "F". The transverse reciprocating motion is controlled by a first eccentric 12 keyed to the end of a main shaft 13 operable in rotation in known manner and originally extending according to a vertical axis of rotation within the base 4. The first eccentric 12 acts on the main feed dog 11 through an articulated-quadrilateral driving mechanism 14, not further described as known per se, operatively engaged in the base 4 and acting on a first support rod 15 of the feed dog itself.

The longitudinal reciprocating motion is in turn transmitted by a first connecting rod 23*a* operatively interposed between the first support rod 15 and a first control lever 16 extending radially from an auxiliary shaft 17 parallel to the main shaft 13 and in side by side relation therewith. The auxiliary shaft 17 carries out an oscillatory motion about its own axis by means of a connecting rod 18 acting on a drive arm 19 carried by the auxiliary shaft, upon command of a second eccentric 20 fixed somewhat to the main shaft 13. In the embodiment shown provision is also made for a differential feed dog 21 operatively aligned with the main feed dog 11 and also subjected to cyclic movements lying in a horizontal plane. To this end the differential feed dog 21 has a second support rod 22 slidably connected to the articulated quadrilateral 14 for being submitted to a transverse reciprocating motion, upon command of the eccentric 12, in the same manner as the main feed dog 11.

Also acting on the second rod 22 of the differential feed dog 21 is a second connecting rod 23*b* connected to a second control lever 24 carried by the auxiliary shaft 17, for the purpose of transmitting the horizontal reciprocating motion to the differential feed dog itself. Connection between the first and second connecting rods 23*a*, 23*b* and the first and second control levers 16, 24 takes place at corresponding elongated holes 16*a*, 24*a* formed in the levers themselves, so as to enable adjustment of the stroke the longitudinal reciprocating motion transmitted to the individual feed dogs 11, 21 through shifting of the pivot points of the connecting rods themselves.

In known manner, the gripping action of the feed dogs 11, 21 for the forward advancing of the workpiece "M" is ensured by effect of the action exerted by a presser foot 25 disposed under the work supporting bed 5 according to a vertical plane, parallel to the needle plate 9, at a seat 25*a* formed in the second stretch the vertical guide 7*a*. The presser foot 25, submitted to the action of a presser device 26 not described as known, lends itself to act elastically on the workpiece "M" so as to push it against the needle plate 9.

In addition, sewing means 27 operates in the region of the needle plate 9 and presser foot 25 and it comprises at least one needle 28 disposed according to a horizontal axis and provided with a reciprocating motion through the needle plate 9 following a trajectory lying in a horizontal plane disposed under the work supporting bed 5 upon command of linkages not shown as known per se and connected to a first crank 29 carried by the main shaft 13. The needle 28, carrying a corresponding thread, passes through the junction edges "G" of the parts 2, 3 so as to form a seam astride of the junction edges themselves in cooperation with a first looper 29 which may be provided with a thread too and is disposed in side by side relation with the needle plate 9, on the opposite side from the presser foot 25 and carrying out a reciprocating motion in a substantially vertical direction perpendicular to the sewing direction "F". Also provided is a second looper 30 which may have a thread or not, is operable with a substantially horizontal reciprocating motion perpendicular to the sewing direction and extends astride of a lower edge 9*b* of the needle plate 9.

The first and second loopers 29, 30 corresponding respectively to the lower and upper loopers conventionally provided traditional overlocking machines are operated by respective drive shafts 31, 32 disposed horizontally and driven with an oscillatory motion about their own axes by linkages, not shown as known per se, receiving motion by a second and a third crank 33, 34 respectively provided along the main shaft 13.

A fourth crank 35 disposed along the main shaft 13 is arranged to operate a blade 35*a* for trimming the junction edges "G", which blade acts immediately downstream of the needle 28 with reference to the sewing direction "F".

Operation of the sewing machine in question described above mainly as regards structure is as follows.

The first and second parts 2, 3 of the workpiece "M" are disposed on the first and second side portions 6,7 of the work supporting bed 5 respectively, so that the corresponding junction edges "G" face each other at the longitudinal slot 8 formed in the work supporting bed itself.

By suitably moving the parts 2, 3 of the workpiece "M" close to each other, the junction edges "G" are folded vertically downwardly and mutually match inside the slot 8. The junction edges "G" enter the region between the needle plate 9 and presser foot 25 under this condition, in order to be submitted to the action of the feeding and sewing means, 10 and 27. A seam is executed in the same manner as in traditional sewing machines, apart from the fact that in the sewing machine in reference the junction edges "G" are oriented according to a vertical plane and the needle 28 acts according to a horizontal trajectory, under the work supporting bed 5.

From the foregoing it appears that the sewing machine of the invention is capable of carrying into effect a new sewing method substantially comprising the following steps:

disposing in coplanar relation according to a horizontal plane, two parts 2, 3 of a workpiece "M" exhibiting respectively facing junction edges "G";

folding the junction edges "G" of the individual parts 2, 3 of the workpiece "M" vertically downwardly;

moving the workpiece parts 2, 2 close to each other so as to make the folded junction edges "G" mutually match;

sewing together the mutually mating junction edges "G" folded downwardly.

Figure 5:
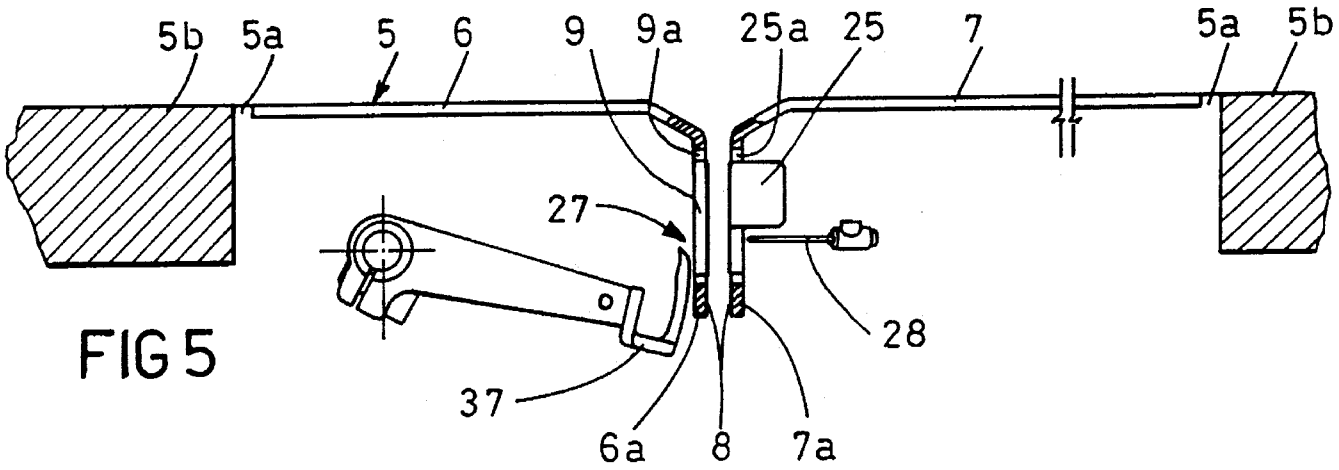
FIG. 5 is a sectional view corresponding to the one in FIG. 3, diagrammatically showing a possible alternative embodiment of the invention.
Figure 6:
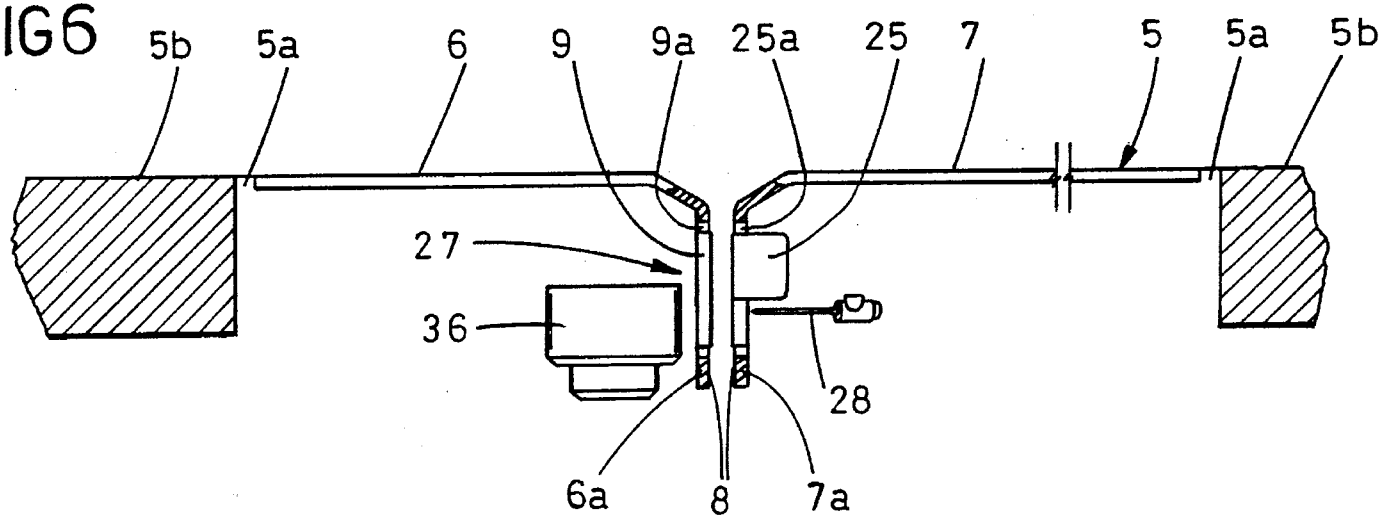
FIG. 6 diagrammatically shows another alternative embodiment of the invention.

Further embodiments of the invention are shown in FIGS. 5 and 6 and they differ from the above embodiment described with reference to FIGS. 1 to 3 as regards the sewing means 27 designed to form stitchings other than overseams.

In more detail in FIG. 6 it is shown a sewing machine 1 designed to form the so-called "lock stitch". In this case the sewing means 27 comprises in addition to one or more needles 28 disposed according to horizontal axes and reciprocating in a horizontal direction through the needle plate 9, a rotating hook 36 disposed alongside the needle plate on the opposite side from the presser foot 25 and operable in rotation.

In the embodiment shown in FIG. 5 and referring to a sewing machine adapted to execute the so-called "double chain stitch" the stitching instrumentalities 27 comprise, in addition to one or more needles 28 quite similar to the previously described ones, a looper 37 alternately movable according to a trajectory lying in a vertical plane perpendicular to the sewing direction.

The present invention achieves the intended purposes.

As a person skilled in the art will clearly understand, the parts of a workpiece disposed on the work supporting bed have their faces designed to form the exposed surfaces of the finished product, oriented upwardly. Therefore, if each of the parts should have patterns reproduced on one of its faces, this face would be turned upwardly and therefore could be clearly seen by an operator when the stitching is being executed. It is apparent that under this situation checking of the mutual alignment of the patterns reproduced on the individual parts of a workpiece becomes much easier.

In addition, since the base, needle plate, presser foot, stitching instrumentalities, feeding means and all other structure elements in the sewing machine are disposed under the work supporting bed, said surface, as a result, is completely clear of any structural element that could hinder the workpiece shifting. This aspect is very advantageous when stitchings on very bulky workpieces are to be executed.

It is also to be pointed out that the sewing machine of the invention can be produced at relatively reduced costs. This advantageous result is achieved above all by virtue of the vertical arrangement of the main shaft enabling the utilization of the same driving mechanisms as provided in known mass-produced machines for driving the different stitching instrumentalities in operation.

It is understood that modifications and variations may be made to the machine as conceived, all of them falling within the scope of the inventive idea characterizing it.

What is claimed is:

1. A sewing method for assembling seams between two parts (2,3) of a workpiece (M), comprising the following steps:

disposing two parts (2,3) of a workpiece (M) in co-planar relation along a horizontal plane, wherein said two parts have respectively facing junction edges (G) said horizontal plane being a workpiece supporting bed being formed of two side portions laying in the same plane and each side portion having a side portion end facing each other and said side portion ends being separated from each other to define a slot (8) extending through said workpiece supporting bed;

folding said facing junction edges vertically downwardly making them mutually match;

passing mutually matched junction edges along said slot in said stitching direction with said two parts being on an upper portion of said workpiece and sewing together said folded downwardly junction edges (G) below said upper portion of said workpiece.

2. A sewing machine comprising:

a base (4) provided with a needle plate (9);

a feeding means (10) having at least one main feed dog (11), said feeding means operating through said needle plate for feeding a work piece (M) according to a stitching direction;

a pressure foot (25) elastically acting against said needle plate;

a stitching means (27) having at least one looper operating within said base and having at least one needle (28) operating close to said pressure foot, said needle cyclically passing through said presser foot and needle plate and in cooperation with said looper making stitches of a seam on said workpiece, said work piece being formed of two workpiece portions (2, 3) exhibiting, respectively, facing junction edges (G);

a workpiece supporting bed (5) being formed of a first and second side portion (6, 7) lying in the same plane, said first side portion has a first end (**6*b*) and said second side portion having a second end (7*b*), said first end facing said second end and being separated from each other to define a slot (8) extending through said workpiece supporting bed in said stitching direction to receive and allow a passage of said facing junction edges along said slot during the execution of said seam, the workpiece supporting bed being arranged close to said base, said needle plate and said presser foot for receiving said workpiece portions in a laid down fashion, the base, needle plate, feeding means, presser foot, and the stitching means (27**) being underneath said workpiece supporting bed; and said needle plate, presser foot and main feed dog being aligned with said stitching direction and disposed perpendicularly to said workpiece supporting bed.

3. The sewing machine as claimed in claim 2, wherein said sewing means (27) and feeding means (10) are operated by a main shaft (13) rotatably engaged in the base (4) and extending according to a substantially vertical axis.

4. The sewing machine as claimed in claim 3, wherein said feeding means (10) comprises at least one main feed dog (11) located at at least one opening (**11*a*) formed in the needle plate (9**) and driven with cyclic movements according to a trajectory lying in a horizontal plane.

5. The sewing machine as claimed in claim 4, wherein said feeding means (10) further comprises at least one differential feed dog (21) operatively aligned with the main feed dog (11) and driven with cyclic movements according to a trajectory lying in a horizontal plane.

6. The sewing machine as claimed in claim 5, wherein the cyclic movements of said main (11) and differential (21) feed dogs consist of a transverse reciprocating motion oriented perpendicularly to the extension plane of the needle plate (9), produced by a first eccentric (12) keyed to one end of said main shaft (13) facing the work supporting bed (5), in combination with a longitudinal reciprocating motion oriented in the sewing direction (F) and transmitted by a second eccentric (20) fixed somewhat to the main shaft itself.

7. The sewing machine as claimed in claim 2, wherein said sewing means (27) comprises at least one needle (28) disposed horizontally under the base (4) and alternately movable through the needle plate (9) according to a horizontal direction substantially perpendicular to the sewing direction (F), as well as at least one looper (29) disposed in side by side relation with the needle plate (9) on the opposite side from the presser foot (25) and alternately movable according to a substantially vertical trajectory.

8. The sewing machine as claimed in claim 7, wherein said sewing means further comprises at least a second looper (30) alternately movable according to a substantially horizontal trajectory and extending astride of a lower edge (**9*b*) of said needle plate (9**).

9. The sewing machine as claimed in claim 2, wherein said at least one needle (28) is disposed horizontally under the work supporting bed (5) and alternately movable through the needle plate (9) according to a horizontal trajectory substantially perpendicular to the sewing direction (F), and at least one rotary hook (36) is disposed in side by side relation with the needle plate (9) on the opposite side from the presser foot (25).

* * * * *